United States Patent [19]

Hubbard

[11] 4,204,369

[45] May 27, 1980

[54] ENTRANCE DOOR SYSTEM WITH AUTOMATIC ASTRAGAL AND PANIC DEVICE

[75] Inventor: S. Eugene Hubbard, Niles, Mich.

[73] Assignee: Kawneer Company, Inc., Niles, Mich.

[21] Appl. No.: 938,641

[22] Filed: Aug. 31, 1978

[51] Int. Cl.[2] ..... E06B 7/20

[52] U.S. Cl. ..... 49/319; 49/366; 292/21; 292/92

[58] Field of Search ..... 49/394, 319, 366; 292/92, 21

[56] References Cited

U.S. PATENT DOCUMENTS

| | | | |
|---|---|---|---|
| 2,610,368 | 9/1952 | Tschaepe | 49/319 |
| 3,124,378 | 3/1964 | Jackson | 292/92 X |
| 3,888,046 | 6/1975 | Meisterheim | 49/366 X |
| 4,009,537 | 3/1977 | Hubbard | 49/319 |

*Primary Examiner*—Kenneth Downey

*Attorney, Agent, or Firm*—Mason, Kolehmainen, Rathburn & Wyss

[57] ABSTRACT

An entrance door system including an automatic astragal along an edge of a door and an operator on the door provided for controlling one or more latch assemblies normally engaged to latch an edge of the door with a member of a door frame in which the door is mounted. The latch assembly is mounted on the door to normally latch the door with the door frame when the door is closed and the latch is releasable to an unlatched condition so that the door may be opened. The elongated astragal is mounted in parallel along the edge of the door and is guided for parallel movement between a retracted and an extended position. The door operator is effective for moving the astragal between retracted and extended positions and the astragal is interconnected for moving the latch assembly to release the latching engagement when the astragal is moved to the retracted position so that the door may be opened.

25 Claims, 11 Drawing Figures

ENTRANCE DOOR SYSTEM WITH AUTOMATIC ASTRAGAL AND PANIC DEVICE

BACKGROUND OF THE INVENTION

1. Field of the Invention

The present invention relates to entrance doors and more particularly, to an entrance door system including in combination, an automatic astragal and a panic or emergency unlocking device used to provide emergency egress from a building when required. The present invention is an improvement on the astragal and panic device system shown and described in U.S. Pat. No. 4,009,537, which patent is assigned to the same assignee as the present invention.

2. Description of the Prior Art

Automatic astragals operated by panic devices are shown and described in the aforementioned U.S. Patent and various astragals and panic devices are shown in the references cited therein. In addition, a panic device operated astragal for an entrance system is shown in U.S. Pat. No. 3,888,046, and a panic device or emergency unlocking device is also shown in U.S. Pat. No. 2,910,857 which patents are incorporated herein by reference.

OBJECTS OF THE INVENTION

It is an object of the present invention to provide a new and improved entrance system for buildings and the like.

More particularly, it is an object of the invention to provide a new and improved building entrance door system having at least one door with an automatic astragal thereon in combination with a panic or emergency unlocking system.

More particularly, it is an object of the present invention to provide a new and improved entrance system of the character described having greatly improved operating characteristics and a system that is greatly simplified in construction and operation thereby reducing initial costs as well as servicing costs in comparison to prior art systems.

Yet another object of the present invention is to provide a new and improved entrance system of the character described where double doors are provided and an improved automatic astragal is mounted on one of the doors for interaction with a leaf on an opposite door to provide improved security.

Another object is to provide an entrance door system wherein an astragal is used for actuating upper and lower bolt lock assemblies so that when the astragal is retracted, the bolts are withdrawn permitting free opening of the door.

Yet another object of the present invention is to provide a new and improved entrance system of the character described wherein greatly improved security against unauthorized entrance is attained.

Yet another object of the present invention is to provide a new and improved automatic entrance system of the character described which provides excellent protection against unwanted retraction of an astragal fomented by pressure applied from the insertion of a pry bar or tool along the lock stile of the door.

Yet another object of the present invention is to provide a new and improved entrance system of the character described wherein the astragal itself is used as an operative element for controlling upper and lower bolt lock assemblies for movement of the assemblies between engaged or locked positions and retracted or disengaged positions with respective upper and lower members of the door frame.

Yet another object of the present invention is to provide a new and improved automatic entrance system of the character described which has fewer moving parts, is lower in cost and which is more fool proof and dependable in operation with less maintenance and servicing being required.

Another object of the present invention is to provide a new and improved entrance system of the character described having a reduced number of moving, operating components therein.

Yet another object of the present invention is to provide a new and improved entrance system of the character described wherein a reduced amount of force is required for retracting an astragal and unlatching one or more door latching mechanisms thereof.

BRIEF SUMMARY OF THE INVENTION

In accordance with the foregoing and other objects and advantages of the present invention, one embodiment by way of representation and not limitation comprises an automatic entrance system including a door having a lock stile and a pair of upper and lower rails. The door is mounted in a door frame including a header and threshold adjacent the upper and lower rails of the door. An upper latching assembly is adapted to bolt lock the door to a header and is releasable to an unlocked position. A lower latching assembly is adapted to bolt lock the door to the threshold and is releasable to an unlocked position. An elongated astragal is mounted along the lock stile and is movable inwardly and outwardly thereon to cooperate with a leaf on an adjacent door stile or a leaf on an adjacent door jamb in the case of a single door. The astragal is movable inwardly and outwardly with respect to the supporting lock stile and is moved between retracted and extended positions by a panic type manual operator located conveniently at an intermediate level on the door. Depression of the operator retracts the astragal and the astragal is connected adjacent upper and lower ends with the upper latching assembly and the lower bolt lock assembly, respectively, so that retraction of the astragal cause both the upper and lower latches to be retracted to a released or unlocked position so that the door can swing open. When the astragal is subsequently returned to an extended position, the upper and lower latching assemblies return to the bolt locked position engaging the header and threshold, respectively, of the door frame to provide a secure entrance system.

The manual operator used may be a U-bar type panic or crash bar as shown in the aforementioned U.S. Pat. Nos. 4,009,537 and 3,888,046 which are incorporated herein by reference or may comprise a crash panel type operator as shown in copending U.S. Patent Application Ser. No. 938,929, filed Sept. 1, 1978, which application is owned by the same assignee as the present application.

BRIEF DESCRIPTION OF THE DRAWINGS

For a better understanding of the present invention, reference should be taken to the following detailed description in conjunction with the drawings, in which.

DESCRIPTION OF THE PREFERRED EMBODIMENT

Figure 1:
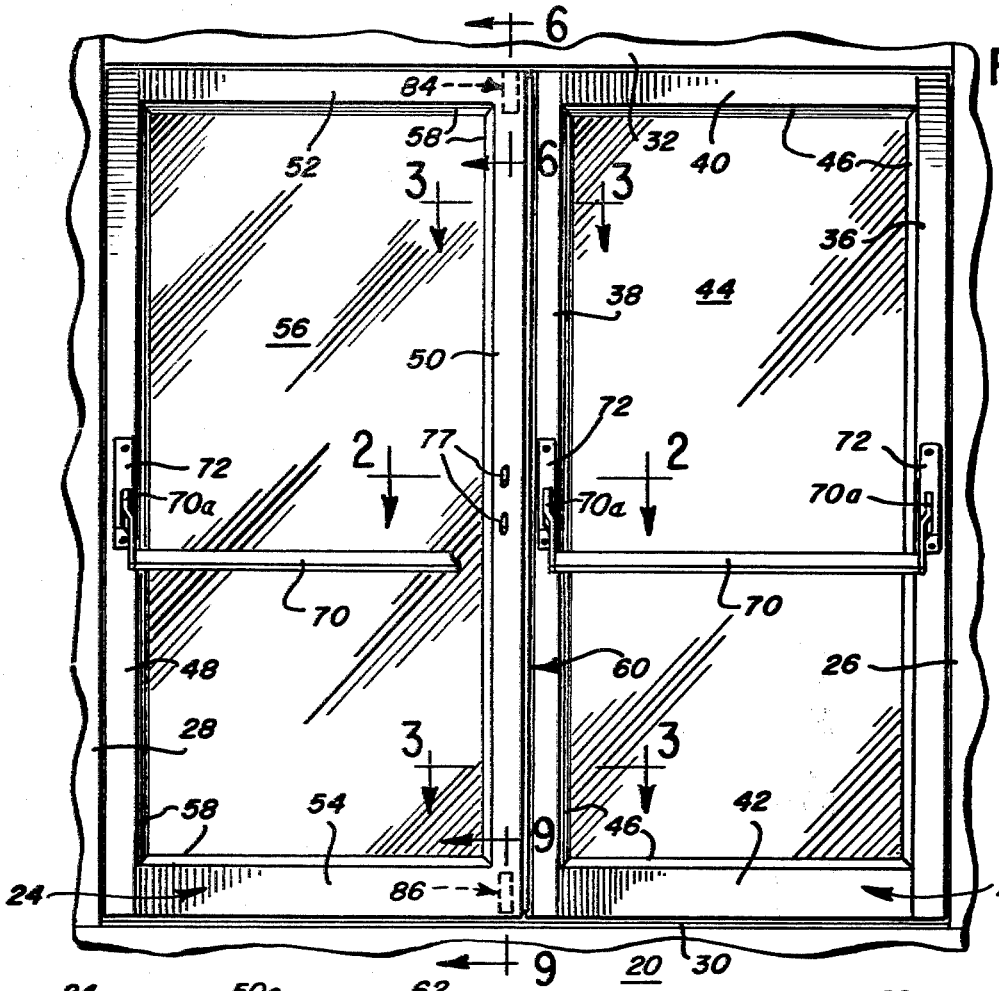
FIG. 1 is an elevational view taken from the interior of a building of a new and improved entrance system constructed in accordance with the features of the present invention.

Referring now more particularly to the drawings, therein is illustrated a new and improved entrance system constructed in accordance with the features of the present invention and referred to generally in FIG. 1 by the reference numeral 20. The entrance system includes an active door 22 and a passive door 24 and each door is mounted for pivotal movement on a respective side frame member or vertical jamb 26 or 28. These jambs are interconnected adjacent their lower ends by a threshold 30 and a header 32 is provided between the vertical jambs above the upper edges of the doors to complete the supporting door frame.

Preferably, the door frame members and the doors are formed of elongated aluminum extrusions and the vertical stiles of the respective doors will be described in greater detail hereinafter. The active door 22 is supported from the adjacent jamb 26 on a pair or more of hinges and a similar pair or more of hinges is provided for supporting the passive door 24 for pivotal movement on a vertical axis adjacent the passive door jamb 28.

The active door includes a rectangular frame comprising a vertical hinge stile 36 and a parallel vertical lock stile 38, and the stiles of the door frame are interconnected adjacent the upper and lower ends by a pair of horizontal, upper and lower rails 40 and 42. The interconnected stiles and rails of the active door form a large rectangular opening and a glazing panel 44 is mounted therein and secured with glazing stops 46 in a conventional manner.

Similarly, the passive door includes a vertical hinge stile 48 and a parallel vertical lock stile 50, and these stiles are interconnected adjacent their upper and lower ends by an upper rail 52 and a lower rail 54. The rails and stiles of the passive door form a large rectangular opening for a glazing panel 56 which is mounted therein with suitable glazing stops 58. It should be understood that the active and passive doors may also be provided with intermediate horizontal rails and in this case, a pair of smaller upper and lower glazing panels would be utilized instead of a single large glazing panel as illustrated.

Figure 2:
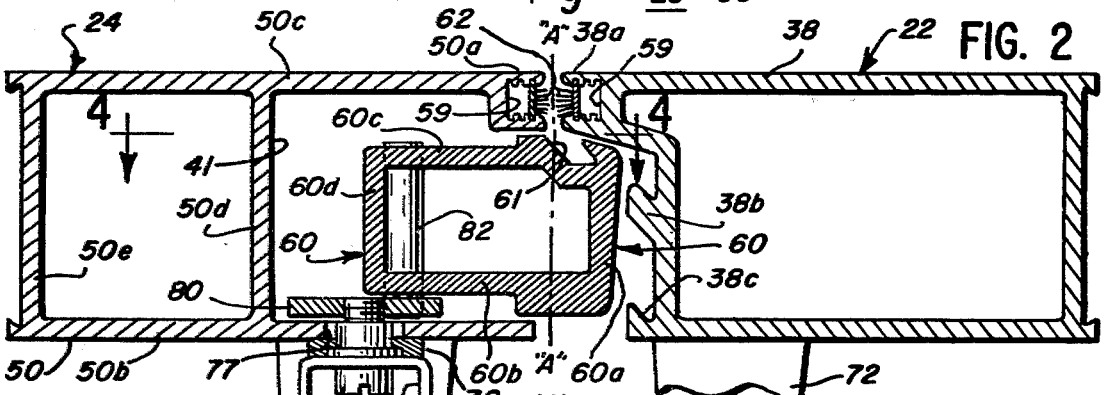
FIG. 2 is a fragmentary, enlarged, horizontal cross-sectional view taken substantially along lines 2—2 of FIG. 1.
Figure 3:
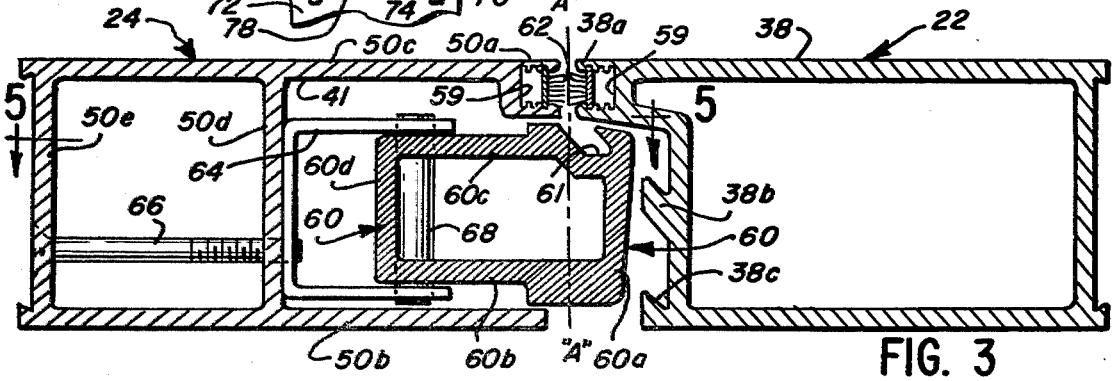
FIG. 3 is a fragmentary, enlarged, horizontal cross-sectional view taken substantially along lines 3—3 of FIG. 1.

In accordance with the present invention, the passive door 24 is provided with an elongated astragal 60 which is mounted on the lock stile 50 and is adapted to cooperate with a projection or leaf 38*a* formed on the lock stile 38 of the opposite active door. In the case of a single active door installation, a cooperating leaf is provided on the adjacent jamb surface of the door frame and in the double door installation as shown, the active door 22 includes a cooperating leaf 50*a* on the lock stile 50 thereof. As illustrated in FIGS. 2 and 3, the outer edge portion of the door leaves 38*a* and 50*a* are formed with grooved recesses 59 in which is mounted an elongated weatherstrip 62 so that a weather seal is formed between the doors when they are closed.

An outer portion or nose 60*a* of the retractable, elongated tubular astragal extends well beyond a center line A—A between the facing edges of the pair of doors when the doors are closed and this outer portion of the astragal is overlapped by the leaf 38*a* making it extremely difficult to effectively use a wire or other burglar implement inserted between the two doors for the purpose of gaining unauthorized entry into the building, such as by forcing the astragal inwardly into the lock stile 50 of the passive door 24. In addition, the lock stile 38 of the active door 22 is provided with a pair of outwardly extending, spaced apart, ribs on the outer face thereof indicated by the numerals 38*b* and 38*c* and these ribs are designed to intercept and/or deflect and render ineffective an inserted tool or burglar implement.

The lock stile 50 of the passive door 24 includes a channel-shaped recess 41 opening outwardly and facing the opposite door and this recess is formed between inside and outside wall portions 50*b* and 50*c*, respectively, which are integrally joined by a pair of spaced apart transverse webs 50*d* and 50*e*. The elongated astragal 60 is mounted in the channel-shaped recess 41 for movement between an outer or normally extended position as shown and an inward or retracted position as illustrated in dotted lines in FIGS. 4 and 5. Movement from the normal to the retracted position is indicated schematically by the upwardly and inwardly sloping arrows "B" of FIGS. 4, 5, 7 and 10.

Figure 5:
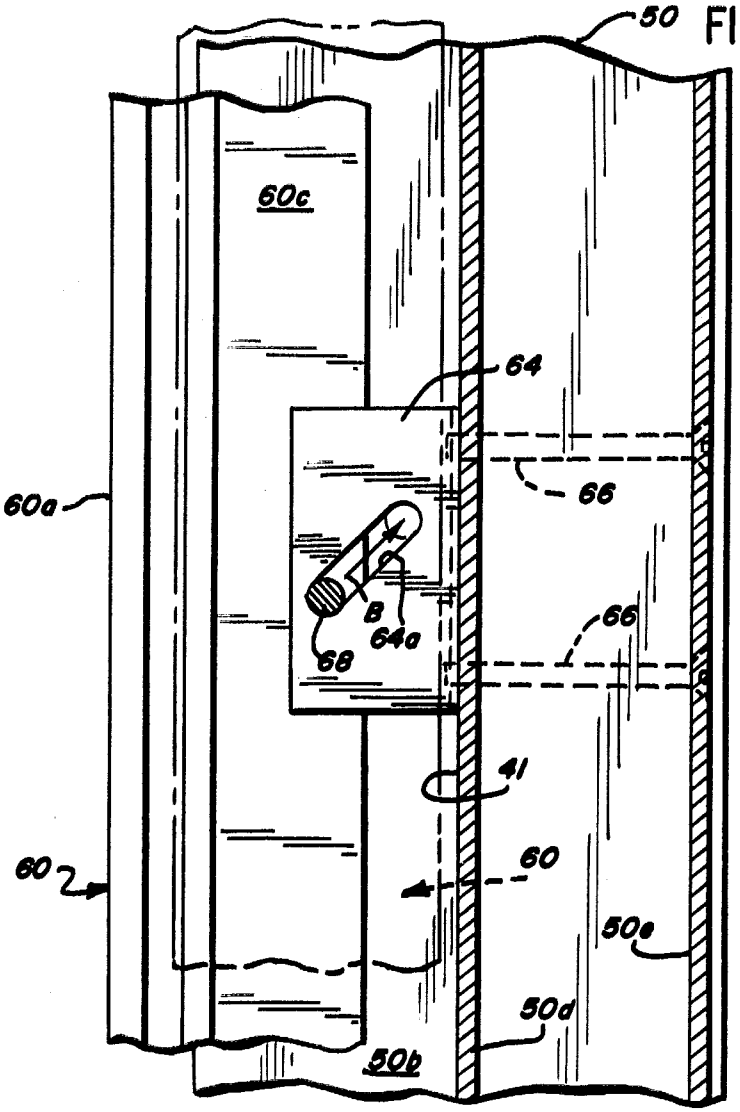
FIG. 5 is a fragmentary, enlarged vertical cross-sectional view taken substantially along lines 5—5 of FIG. 3.

The astragal extends along substantially the entire height of the door edge and is supported within the channel on a pair or more of upper and lower channel-shaped clips 64, which are shown in FIGS. 3 and 5. These clips are secured with their webs against the webs 50*d* of the stile 50 by means of elongated screw fasteners 66 extending through aligned openings in both of the webs 50*d* and 50*e* of the lock stile. As best illustrated in FIG. 5, the opposite side flanges of the channel-shaped astragal supporting clips are formed with upwardly and inwardly extending elongated slots 64*a* and these slots accommodate a transverse cross-pin 68 which extends between the opposite side walls of the hollow tubular astragal 60 and projects outwardly from the side faces thereof for engagement within the sloped slots. Accordingly, when the astragal 60 is retracted inwardly it is also moved upwardly on a slope as indicated by the arrows "B" and when the inward retracting forces are removed, the weight of the astragal itself tends to cause the astragal to return downwardly and outwardly to the fully extended or normal position as shown in solid lines.

As indicated in FIGS. 2, 3, 8 and 11, the elongated astragal is formed of a hollow aluminum extrusion having a relatively thick outer nose portion 60*a* and a pair of opposite side walls 60*b* and 60*c* integrally joined along their inner edges by a transverse web 60*d*. The outer nose portion 60*a* of the astragal is relatively thick in comparison to the side walls and the inside web and a wire intercepting slot or groove 61 is provided on the outwardly facing surface of the nose portion to aid in intercepting or deflecting wires or tools which might be inserted for the purpose of unauthorized opening of the door.

The active door 22 is provided with a panic type push bar 70 of generally U-shaped configuration and a pair of vertical legs 70*a* of the push bar are pivotally secured in a pair of housings 72 mounted on the inside faces of the door stiles 36 and 38. The passive door 24 is provided with a similar type push bar and the legs of the push bar are pivotally secured in similar housings mounted on the inside walls of the door stiles 48 and 50.

As described in the aforementioned U.S. Patents incorporated herein by reference, the panic type push bar 70 on the passive door 24 may be activated in an emergency to retract the astragal 60 so that the normally locked door may be opened toward the outside. For this purpose, the upper end portions of the legs 70*a* are adapted to engage the lift a pair of channel-shaped slides 74 (FIG. 2) which are mounted for vertical sliding movement on the inside wall faces of the respective door stiles. Each slide is supported for vertical sliding movement on a door stile by a pair of hollow "Nylon" annular bushings 76 (FIGS. 2 and 4) and these bushings include smaller diameter portions which are seated for vertical sliding movement within a pair of upper and lower, vertically aligned elongated grooves 77 (FIGS. 2 and 4) which are drilled and machined in the inside faces of the door stiles 48 and 50. When the bight or horizontal bar of the panic type push bar 70 is depressed inwardly, the channel-shaped slides 74 inside the housing 72 are moved vertically upwardly and guided by on the bushings 76 which are slidable vertically within the elongated slots 77 as shown best in FIG. 4.

Figure 4:
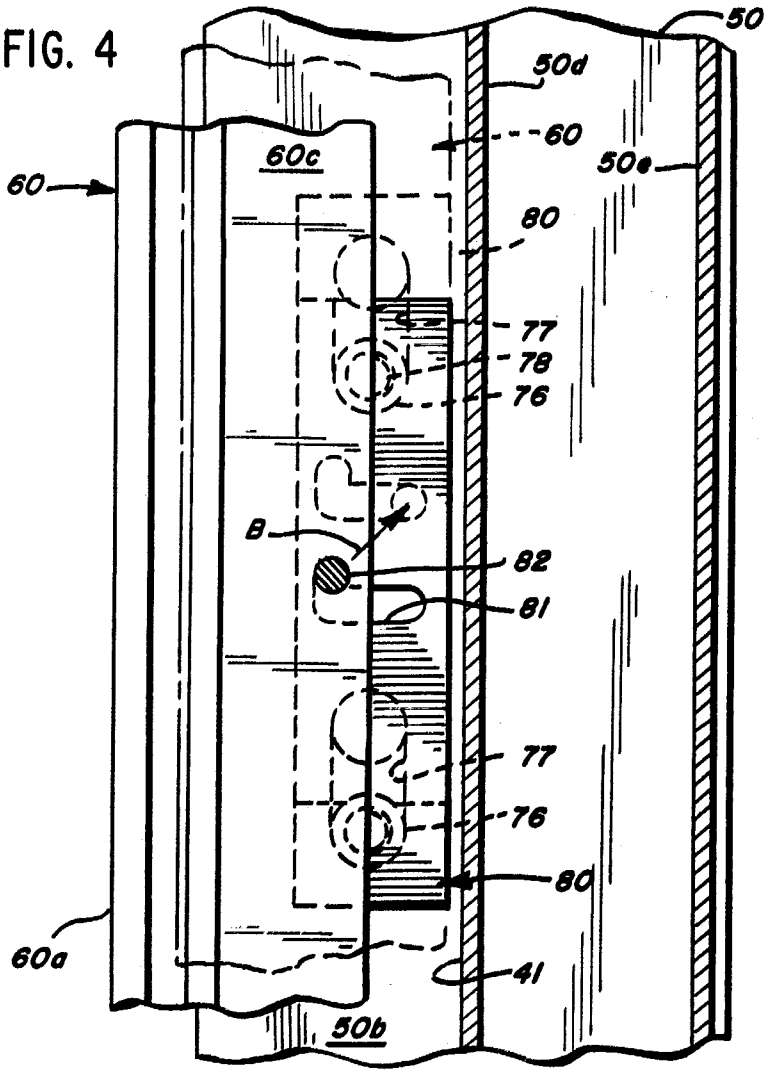
FIG. 4 is a fragmentary, enlarged vertical cross-sectional view taken substantially along lines 4—4 of FIG. 2.

The weight of the astragal 60 urges the channel slides downwardly toward the lower position with the bushings 76 stopped against the lower ends of the respective vertically aligned slots 77. Each bushing includes a hollow bore through which is extended a fastener or cap screw 78 having a threaded shank secured in respective ones of a pair of vertically spaced drilled and tapped openings formed in a vertical slide bar 80 which is mounted for vertical sliding movement on the inside face of the inside wall 50*b* of the door stile 50 in the channel 41 as shown in FIG. 4. The slide bar 80 is movable between a lower position shown in solid lines and an upward or elevated position as shown in dotted lines and the slide is constrained to move only in a vertical direction by virtue of the pin and slot type connections as shown.

A transverse lift pin 82 is provided in the astragal 60 at mid level adjacent the transverse web 60*d* and the pin extends through the opposite side walls 60*b* and 60*c* and projects into an L-shaped slot 81 formed in the lift slide 80 intermediate the ends thereof as illustrated best in FIG. 4. The slot 81 includes a vertical segment and a horizontal segment and when the astragal 60 is at rest in the outward or normally extended position, the lift pin 82 is seated against the upper end of the short vertical segment of the L-shaped slot to provide a dead lock feature whereby the astragal 60 may not be forced inwardly toward the retracted position by the application of external force inwardly against the nose 60*a*.

However, when the slide bar 80 is lifted in a vertical direction by application of pressure on the panic push bar 70, the horizontal segment of the L-shaped slot is moved upwardly relative to the pin 82, until the lift pin engages the lower surface thereof. Further upward travel of the slide bar begins to elevate the astragal upwardly and as this proceeds, the astragal is retracted both inwardly and upwardly by virtue of the pin and slot connections between the astragal support pins 68 and the sloped slots 64*a* in the flanges of the astragal support clips 64.

In accordance with a feature of the present invention, the upward and inward retraction of the astragal as described is effective to activate a trigger and thereby permit unlatching of a latch element of an upper latching assembly 84 mounted adjacent the upper end portion of the lock stile 50 and cooperative with the header 32. At the same time a latch element of a lower latching assembly 86 mounted adjacent the lower end portion of the lock stile 50 is withdrawn by the lifting of the astragal.

Figure 8:
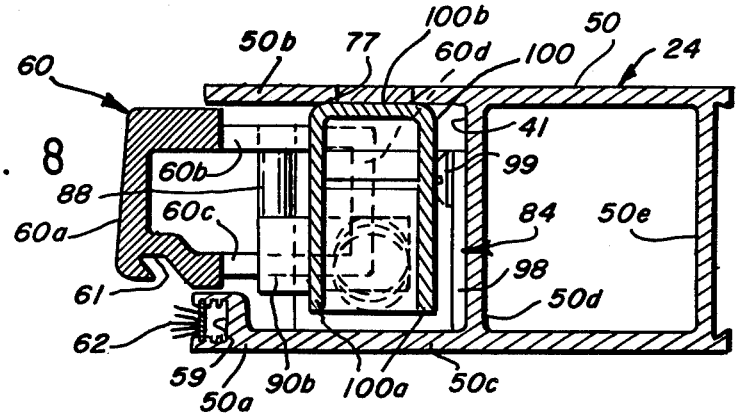
FIG. 8 is a fragmentary, enlarged horizontal cross-sectional view taken substantially along lines 8—8 of FIG. 7.
Figure 6:
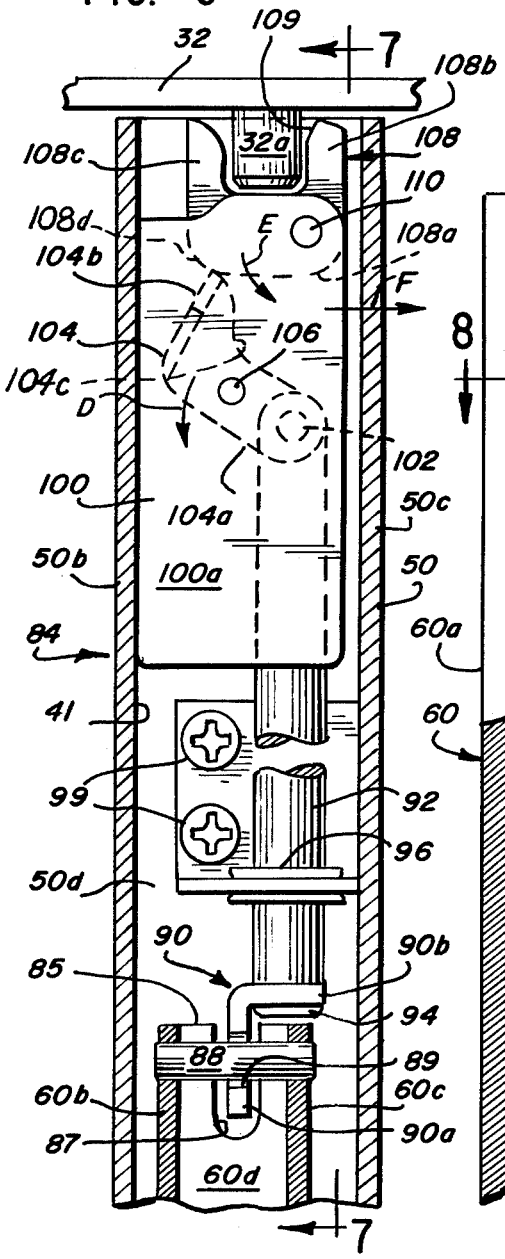
FIG. 6 is a fragmentary, enlarged vertical cross-sectional view taken adjacent an upper corner portion of the entrance door showing the interconnection between the astragal and an upper bolt lock assembly, taken substantially along lines 6—6 of FIG. 1.
Figure 7:
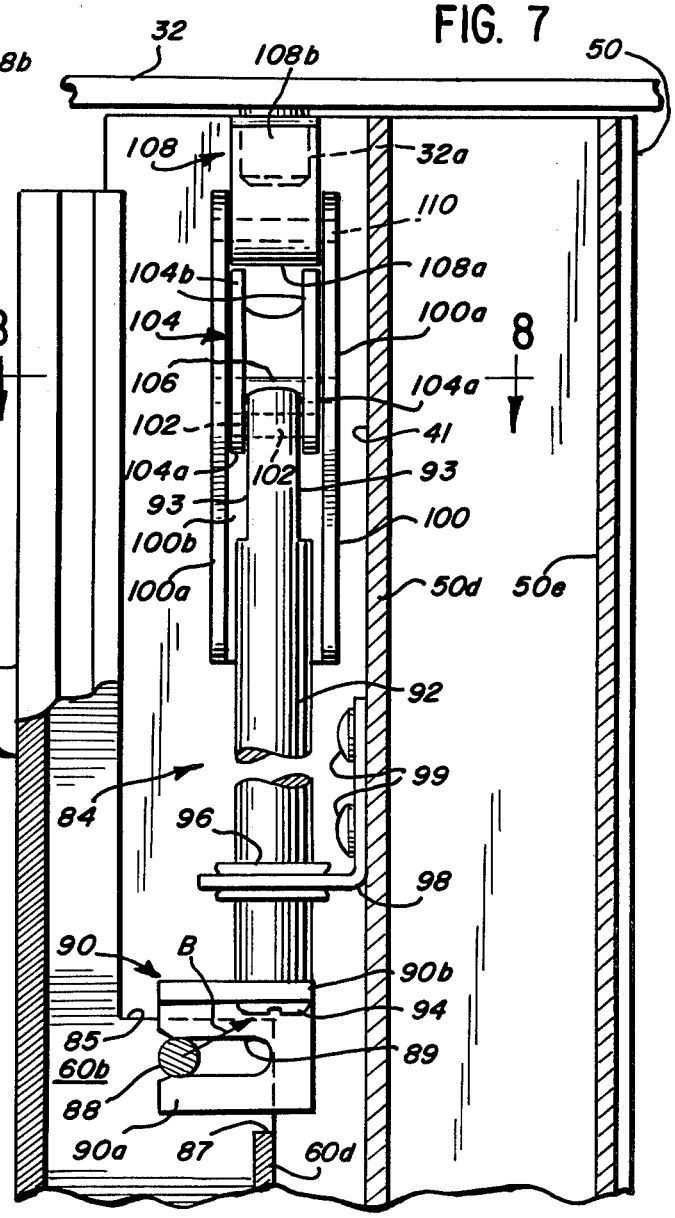
FIG. 7 is a fragmentary, enlarged, vertical cross-sectional view taken substantially along lines 7—7 of FIG. 6.
Figure 11:
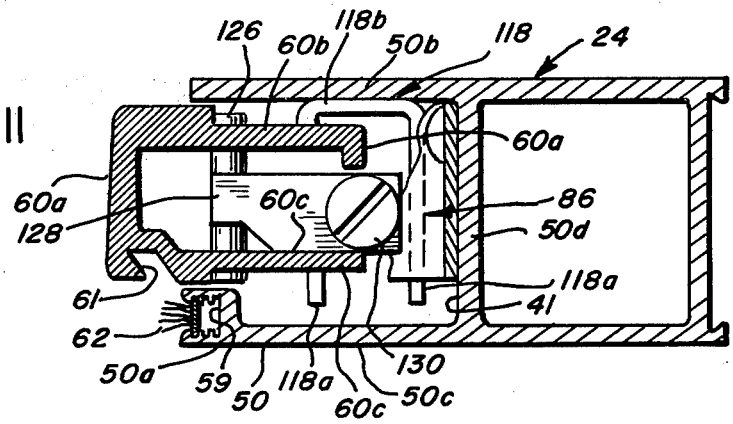
FIG. 11 is a horizontal, cross-sectional view taken substantially along lines 11—11 of FIG. 10.
Figure 9:
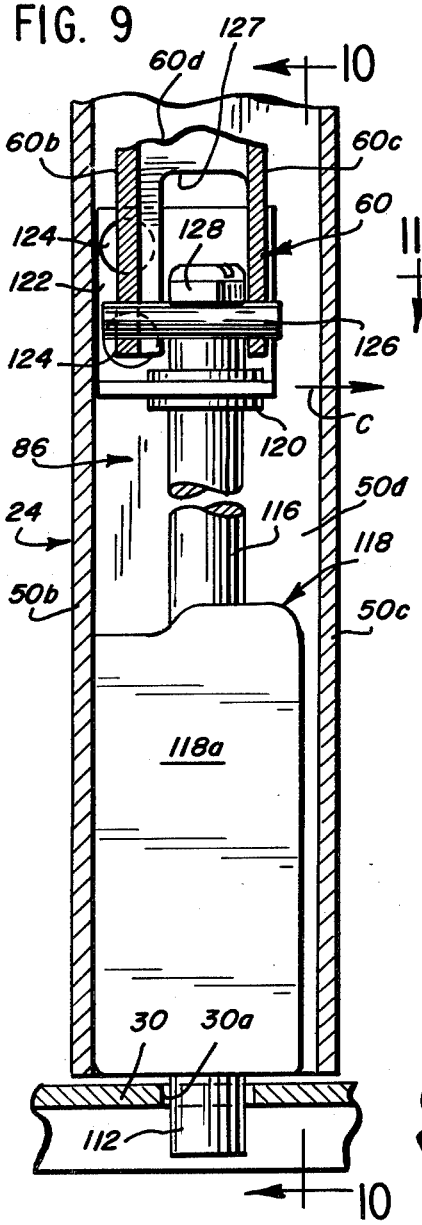
FIG. 9 is an enlarged, fragmentary, vertical cross-sectional view similar to FIG. 6 but illustrating a lower corner portion of the door showing the interconnection between the astragal and a lower bolt lock assembly taken substantially along lines 9—9 of FIG. 1.

Referring to FIGS. 6, 7 and 8, in order to accommodate the upper latching assembly within the channel recess 41 at the upper end of the lock stile 50, the side walls 60*b*, 60*c* and the web 60*d* of the astragal are coped away as at 85 and 87, respectively, as shown in FIGS. 6 and 7. The astragal is provided with a transverse cross-pin 88 extending between the side walls 60*b* and 60*c* just below the upper level of the coped or cut away portion and this cross-pin is seated for sliding movement in a groove 89 extending horizontally and opening outwardly in a vertical flange 90*a* of an angle clip 90 having a horizontal upper flange 90*b*. The flange 90*b* is secured to the lower end of a vertical actuating rod 92 by an axially extending threaded cap screw 94 and the threaded shank portion of the cap screw extends inwardly and upwardly into an axial threaded bore in the lower end of the rod 92. The rod is supported for generally vertical movement in a grommet or bushing 96 carried in a circular aperture in the horizontal flange of an angle bracket 98 which is secured to the web 50*d* of the stile by a pair of fasteners 99.

As illustrated in FIG. 7, when the astragal 10 is retracted inwardly and upwardly as indicated by the arrows "B", the pin 88 engaged within the slot 89 of the clip 90 causes the actuator rod 92 to move generally upwardly from the position as shown to release a trigger element of the upper latching assembly 84.

The assembly includes a channel-shaped housing or base 100 having opposite side walls 100*a* parallel of the web 50*d* and a bight or web portion 100*b* secured to the transverse inside wall 50*b* of the door stile 50. The upper end portion of the actuator rod 92 extends upwardly between the side flanges 100*a* and is formed with a pair of flatted surfaces 93 on opposite sides parallel of the inside faces of the housing flanges 100*a* as shown in FIG. 7. A transverse connector pin 102 pivotally interconnects an upper end portion of the actuator rod 92 adjacent the flats 93 with a lower leg 104*a* of an L-shaped trigger element 104 having a pair of upstanding legs 104*b* disposed on opposite sides of the flats 93 on the actuator rod. The trigger element is pivotally secured in the U-shaped housing 100 by a pivot pin 106 intermediate the ends of the lower legs 104*a* and the pivot pin extends transversely between opposite side walls 100*a* of the channel-shaped housing.

When the upper end of the actuator rod 92 is forced upwardly by retraction of the astragal 60, the trigger 104 is pivoted about the axis of the pin 102 in a counterclockwise direction as indicated by the arrows "D" and this permits the curved upper ends of the legs 104*b* to move downward. When this occurs, a U-shaped bolt latch element 108 having a lower bight 108*a* and a pair of generally upstanding spaced apart latch legs 108*b* and 108*c*, respectively, is permitted to pivot as indicated by the arrows "E" (FIG. 6) and move out of engagement with a depending latch dog 32*a* extending downwardly from the header 32 of the door frame. The bolt latch element 108 is pivotally mounted between the side flanges 100*a* on another transverse pivot pin 110, which pin is offset with respect to the center of the bight portion 108*a*. When the trigger 104 is pivoted by elevation of the actuator rod 92, the U-shaped latch element 108 then is permitted to pivot in a counterclockwise direction and this action permits unlatching of the door at the upper level out of the normally latched relation with the header 32 of the door frame so that the door may be opened outwardly in the direction of the arrow "F" (FIG. 6).

Because of the eccentric relation of the pin 110 with respect to the latch element 108, when the door is opened the bight portion 108*a* rotates from a generally horizontal position to a position sloping downwardly toward the inside of the door and tends to remain in this unlatched condition until the door is again closed and latched. When the latch element 108 is in an unlatched condition, a rounded lower corner surface 108*d* (on the lower left hand corner as viewed in FIG. 6) becomes seated against a similarly rounded, inside corner surface 104*c* of the trigger element 104. This engagement between the corner surface 108*d* and 104*c*, prevents the trigger element from returning to the latching position as shown and the trigger element thus retains the actuating rod 92 and the interconnected astragal 60 in the upwardly and inwardly retracted position while the door is open.

When the door is again closed, cam surfaces 109 on the leg 108*b* of the latch element engage the depending lug 32*a* on the door frame header 32 and this engagement causes the latch element to pivot back toward the upright latching position as shown in FIG. 6. As this occurs, the trigger element is released to pivot in a clockwise direction back to the latching position as shown because of the weight of the astragal 60 and the actuator rod 92 acting to return the astragal to the outwardly extended downward position as shown. In this normally outwardly extended position, the astragal is effective to retain latched engagement between the latch element 108 and the lug 32*a* acting through the trigger element 104. It will thus be seen that inward and upward retraction of the astragal 60 is effective to unlatch the upper latching assembly 84 permitting the door to be opened outwardly and a return of the astragal to the normal position when the door is closed is effective to retain the latch assembly in a latched condition for securing an upper corner portion of the door with the header of the door frame in the closed position.

The lower latching assembly 86 is actuated by the lower end portion of the astragal 60 which acts to upwardly retract a bolt element or lock pin 112 having a lower end portion which is generally movable in a vertical direction and is normally positioned to extend downwardly into latched engagement within an aperture 30*a* formed in the upper surface of the threshold 30 of the door frame. The upper end portion of the lock pin or bolt 112 is interconnected to the lower end portion of a coaxial spring 114 having its upper end portion interconnected with a generally vertically movable actuator rod 116 similar to the actuator rod 92 as previously described.

In the event the slot or opening 30*a* of the threshold or area therebeneath becomes filled with debris, dirt or other obstructions, the spring 114 will permit closure of the door by permitting relative movement between the actuator rod and latch bolt. The actuator and latch bolt are coaxially aligned for vertical sliding movement between a pair of spaced apart parallel side flanges 118*a* of a channel shaped base or support element 118 having a bight portion 118*b* secured to the inside wall member 50*b* of the door stile 50 within the channel 41. An upper end portion of the actuator rod is slideably disposed in a grommet 120 carried in an opening or aperture in a horizontal flange segment of an angle bracket 122 having a vertical flange secured to the transverse web 50*d* of the door stile by appropriate fasteners 124.

Figure 10:
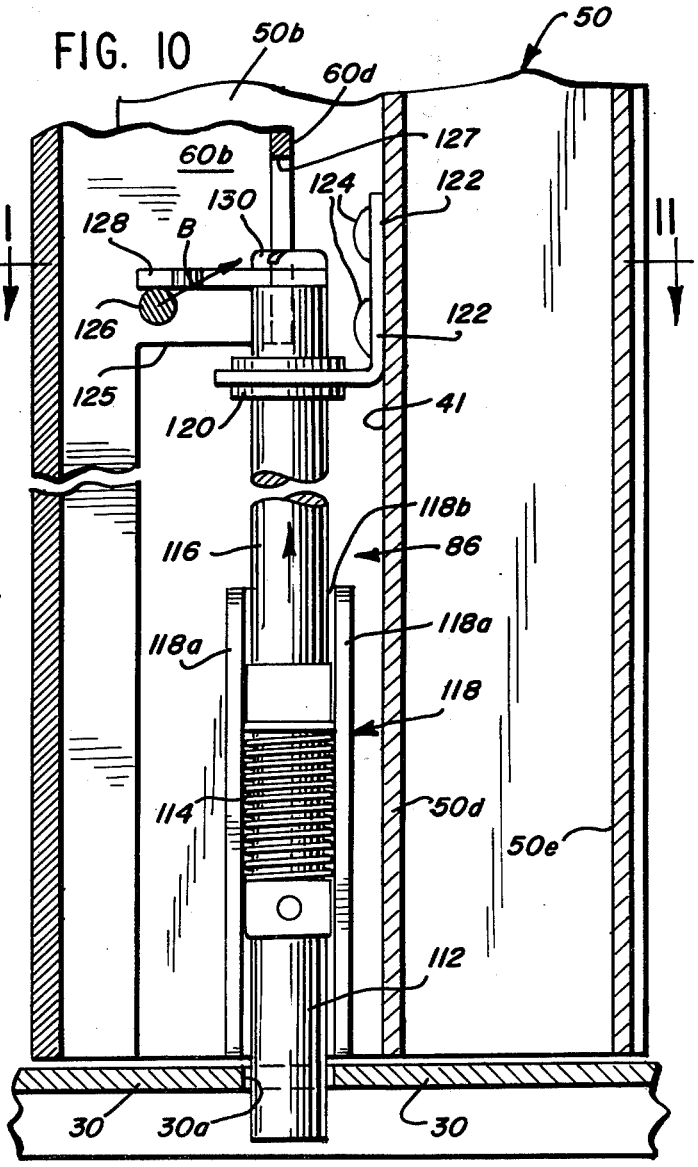
FIG. 10 is an enlarged, fragmentary, vertical cross-sectional view taken substantially along lines 10—10 of FIG. 9.

As illustrated, the lower portion of the side walls 60*b*, and 60*c* of the astragal 60 are coped out or cut away as at 125 to provide space for the bracket, actuator rod and base within the channel 41 at the lower end portion of the door stile as best shown in FIG. 10. Upwardly, above the coped portion 125 on the astragal side walls 60*b* and 60*c*, a lift pin 126 extends transversely across between the side walls and an upper surface portion of this lift pin engages the under side of a lift plate 128 secured to the upper end of the actuator rod 116 by a cap screw 130 having threaded shank coaxially aligned in a threaded bore in the upper end of the actuator rod. The transverse web 60*d* of the astragal is coped away at an upper level 127 in order to accommodate the lift plate 128 and the upper end portion of the actuator rod 116 so that when the astragal is retracted upwardly and inwardly as shown by the sloping arrow "B", the actuator rod 116 in turn is lifted upwardly to retract the latch bolt 112 from latching engagement within the aperture 30*a* of the upper wall of the threshold 30.

When the astragal is fully retracted, the door is unlatched at the bottom edge and is then free to open in an outward direction. When the astragal is returned to the downward, extended position as shown in solid lines, the lift pin 126 moves downwardly and the lift plate 128 follows the lift pin thus permitting the actuator rod and the lock pin or bolt 112 to penetrate the opening 30*a* in the threshold and return to the latched condition providing a bolt latching engagement between a lower corner portion of the door and the threshold 30 of the door frame.

From the foregoing it will be seen that the entrance door 24 equipped with the astragal 60 which activates normally latched, upper and lower latching assemblies 84 and 86 is simple in construction and operation, relatively low in cost and provides the needed panic opening feature in an extremely efficient and foolproof manner. The astragal 60 performs a dual function in providing a continuous leaf along the outer door edge with cooperates with a fixed jamb or an adjacent door, and in actuating one or more normally latched, latching assemblies.

Although the present invention has been described with reference to a single illustrated embodiment thereof, it should be understood that numerous other modifications and embodiments can be devised by those skilled in the art that will fall within the spirit and scope of the principles of this invention.

What is claimed as new and desired to be secured by Letters Patent of the United States is:

1. In combination:

a door having an elongated edge and mounted in a door frame;

latch means on said door adapted to normally latch said door with said door frame and releasable to an unlatched condition;

an elongated astragal mounted in parallel along said door edge for movement inwardly and outwardly relative to said edge between retracted and extended positions;

manual actuator means on said door for moving said astragal between said retracted and extended position; and means interconnecting said astragal with said latch means for unlatching the same when said astragal is moved toward said retracted position by said actuator means.

2. The combination of claim 1 including means for guiding said astragal for relative movement in parallel with said door edge when said astragal is moved between said retracted and extended positions.

3. The combination of claim 1 wherein said door edge includes an elongated recess for said astragal and said latch means is mounted in said recess for controlled latching and unlatching relation with said door frame.

4. The combination of claim 3 wherein said latch means includes at least one mechanical latch mechanism adjacent an end portion of said astragal and interconnected therewith.

5. The combination of claim 1 wherein said latch means includes one or more latch mechanisms mounted at an end(s) of said astragal for controlled movement between latching and unlatching relation with said door frame.

6. The combination of claim 1 wherein said latch means is biased into an engaged, latching relation with said door frame and is movable toward an unlatched condition out of engagement with said door frame in response to movement of said astragal toward said retracted position.

7. The combination of claim 5 wherein one of said latch mechanisms is biased into an engaged, latching relation with said door frame and is movable toward an unlatched condition with respect to said door frame in response to movement of said astragal toward said retracted position.

8. The combination of claim 5 wherein one of said latch mechanisms is normally retained in latching relation with said door frame when said astragal is in said extended position.

9. The combination of claim 8 wherein said one latch mechanism includes a trigger normally maintaining the mechanism in latched relation with said door frame when said astragal is in said extended position, and said trigger is movable to permit unlatching of said mechanism when said astragal is moved to said retracted position.

10. The combination of claim 9 wherein said trigger includes means for retaining said astragal in said retracted position while said mechanism is in unlatched relation with said door frame.

11. The combination of claim 2 wherein said door edge includes opposite walls forming an outwardly opening recess along a free edge of said door and said astragal includes a nose portion facing outwardly of said recess and a pair of side walls extending outwardly thereof between said walls of said door, said guiding means including at least a pair of longitudinal spaced apart connectors along said edge for maintaining said astragal in parallel with said door edge during movement between said extended and retracted position, said manual actuator means spaced at a point along said edge between said connectors.

12. The combination of claim 11 wherein said latch means is spaced in an opposite direction from a connector and said actuator means.

13. The combination of claim 11 wherein said latch means includes a pair of spaced latch mechanisms mounted in said recess outwardly of said connectors.

14. The combination of claim 13 wherein said interconnecting means comprises a connector mechanism between opposite end portions of said astragal and an adjacent one of said latch mechanisms.

15. The combination of claim 1 wherein movement of said astragal in a direction toward said retracted position causes unlatching of said latch means and said latch means is operable upon closing of said door with respect to said door frame to permit said astragal to return toward said extended position.

16. The combination of claim 1 including means for moving said astragal toward said extended position when said door is closed with respect to said door frame.

17. The combination of claim 16 including means for retaining said astragal in said retracted position until said door is closed.

18. The combination of claim 1 including a second door mounted in said frame including an edge closely adjacent said edge of said first mentioned door when said doors are in a closed position in said frame, said edge of said second door including an outwardly projecting leaf portion and said astragal movable between said extended position overlapping said leaf portion and a retracted position clear of said leaf portion permitting said first mentioned door to swing freely open.

19. The combination of claim 18 wherein said leaf portion forms an outside face portion of said second door and said astragal is spaced toward the inside thereof when in said extended position in overlapping relation therewith.

20. The combination of claim 19 wherein said astragal includes an outside facing wall portion inside of said leaf portion when said doors are closed with said astragal in said extended position, and stop means on said outside facing wall portion for engaging an instrument inserted inwardly between said leaf portion and an adjacent facing surface of said edge of said first mentioned door.

21. The combination of claim 20 wherein said stop means comprises an elongated groove in said astragal having a deflection surface at an acute angle with respect to an outside face of said first mentioned door means.

22. The combination of claim 18 wherein said edge of said second door includes a face closely adjacent and facing an outer nose portion of said astragal when said doors are closed.

23. The combination of claim 22 wherein said face of said edge of said second door includes stop means for engaging an instrument inserted between the edges of said doors from outside thereof when closed.

24. The combination of claim 23 wherein said stop means comprises an elongated groove formed in said face and having a deflecting surface at an acute angle with respect to an outside face of said second door.

25. The combination of claim 1 including means for deadlocking said astragal in said extended position against inward movement by the application of pressure against said astragal.

* * * * *